US008231360B2

(12) United States Patent
Steigerwald et al.

(10) Patent No.: US 8,231,360 B2
(45) Date of Patent: Jul. 31, 2012

(54) HYDROSTATIC PUMP WITH A MECHANICAL DISPLACEMENT VOLUME CONTROL

(75) Inventors: Martin Steigerwald, Glattbach (DE); Burkhard Sturmer, Kleinostheim (DE)

(73) Assignee: Linde Material Handling GmbH, Aschaffenburg (DE)

( * ) Notice: Subject to any disclaimer, the term of this patent is extended or adjusted under 35 U.S.C. 154(b) by 612 days.

(21) Appl. No.: 12/427,041

(22) Filed: Apr. 21, 2009

(65) Prior Publication Data

US 2009/0269214 A1 Oct. 29, 2009

(30) Foreign Application Priority Data

Apr. 24, 2008 (DE) ..... 10 2008 020 596

(51) Int. Cl.
*F04B 49/00* (2006.01)

(52) U.S. Cl. ..... 417/213; 417/270

(58) Field of Classification Search ..... 417/213, 417/270, 222.1; 60/443, 452
See application file for complete search history.

(56) References Cited

U.S. PATENT DOCUMENTS

| | | | | | |
|---|---|---|---|---|---|
| 4,559,778 | A * | 12/1985 | Krusche | ..... | 60/447 |
| 4,663,714 | A * | 5/1987 | Cornell et al. | ..... | 701/52 |
| 4,733,533 | A * | 3/1988 | Deininger et al. | ..... | 60/431 |
| 5,355,675 | A * | 10/1994 | Mayhugh et al. | ..... | 60/327 |
| 5,890,982 | A * | 4/1999 | Meyerle | ..... | 475/72 |
| 2004/0141849 | A1 * | 7/2004 | Deneir et al. | ..... | 417/32 |

* cited by examiner

*Primary Examiner* — Toan Ton
*Assistant Examiner* — Kevin Quarterman
(74) *Attorney, Agent, or Firm* — The Webb Law Firm

(57) ABSTRACT

A hydrostatic pump (1) has a mechanical displacement volume control with a mechanical control element (4), which for generation of an actuator pressure that acts on a positioning piston (5) which is functionally connected with a displacement setting device (3), has a position-controlled control valve (6) functionally connected with a control lever (30) and with the displacement setting device (3) of the pump (1). A pump with a mechanical displacement volume control with a pressure limiting function can be accomplished by mechanically decoupling the control lever (30) from the displacement setting device (3) whereby a pressure cutoff function is provided, with which, by respective pilot valves (21*a*, 21*b*), a pressure signal can be generated from a delivery line (2*a*, 2*b*) of the pump (1), which signal is transmitted via the control valve (6) to the positioning piston (5) and counteracts the control pressure.

10 Claims, 3 Drawing Sheets

HYDROSTATIC PUMP WITH A MECHANICAL DISPLACEMENT VOLUME CONTROL

CROSS-REFERENCE TO RELATED APPLICATION

This application claims priority to German Application DE 10 2008 020 596.6, filed Apr. 24, 2008, which is herein incorporated by reference in its entirety.

BACKGROUND OF THE INVENTION

1. Field of the Invention

This invention generally relates to a hydrostatic pump with a variable displacement volume which can be operated in a closed circuit. The pump has a mechanical displacement volume control with a mechanical control element. The mechanical control element comprises a piston-controlled control valve for the generation of a control pressure that acts on a positioning piston, which is functionally connected with a displacement volume setting device, in particular a swashplate. The position-controlled control valve is functionally connected with a control lever and with the displacement setting device of the pump.

2. Technical Considerations

Hydrostatic pumps of this general type with variable displacement volumes which are operated in a closed circuit are used, for example, as pumps in traction drives of mobile work machines.

On mechanical displacement volume control systems of pumps of the known art, it has not been possible to provide a pressure cutoff function because there is a positive mechanical coupling between the control lever and the displacement setting device formed by the swashplate.

On a known pump illustrated in FIGS. 1*a* to 1*c* having a mechanical displacement volume control, the control lever 30 is coupled with a cam plate 31 which is provided with an arc-shaped groove 41 in which one end of an actuator lever 42 is engaged by means of a pin 43. The actuator lever 42 is also in functional communication with a spool element of a position-controlled control valve 6 for its actuation. The displacement setting device, which is in the form of a swashplate, is also in functional communication by means of an assembly 44 with the actuator lever 42, for example, by means of a pin 45. The actuator lever 42 also affects a positive mechanical coupling between the control lever 30 and the displacement setting device to achieve a mechanical emergency actuation of the displacement setting device by means of the control lever 30 in the event that the supply pressure of the control valve 6 fails.

For this purpose, on the second end of the actuator lever 42 there is a notch 46 in which the assembly 44 connected with the displacement setting device is engaged with a defined amount of clearance by means of a pin 47. If the control pressure feed to the control valve 6 fails, when the control lever 30 is actuated by means of the cam plate 31, the actuator lever 42 is pivoted around the pin 45 of the assembly 44 so that a defined clearance between the notch 46 and the pin 47 of the assembly 44 is closed. The notch 46 of the actuator lever 42 therefore comes into contact with the pin 47, as a result of which the actuator lever 42 is connected via the assembly 44 directly with the displacement setting device so that there is a positive mechanical coupling between the actuator lever 42 and the displacement setting device. When the control lever 30 is actuated and thus the cam plate 31 is actuated via the actuator lever 42, the displacement setting device (such as a swashplate) can be pivoted directly mechanically.

With a pressure cutoff function, during the acceleration phase, when a maximum pressure is reached in a delivery line of the pump, the pump is controlled to reduce the displacement volume. As a result, a response by the overpressure protection device of the closed circuit, such as a pressure relief valve, is prevented. This measure prevents hydraulic fluid from flowing out of the circuit via the overpressure protection device, which would result in power losses as well as an unnecessary heating of the hydraulic fluid. As a result of the mechanical positive coupling between the control lever and the displacement setting device in the pump with a mechanical displacement volume control of the known art illustrated in FIGS. 1*a* to 1*c*, if the displacement setting device in the form of a swashplate were to pivot back, the control lever would also be actuated. This means that a pressure cutoff function cannot be provided with the mechanical displacement volume control of the known art.

Therefore, it is an object of this invention to provide a pump with a mechanical displacement volume control which is provided with a pressure cutoff function with little construction effort.

SUMMARY OF THE INVENTION

The invention teaches that the control lever is mechanically uncoupled from the displacement setting device, whereby a pressure cutoff function is provided in which, by means of respective pilot valves, a pressure signal can be generated from a delivery line of the pump. The pressure signal is transmitted via the control valve to the positioning piston and counteracts the control pressure. It has been shown that the mechanically positive coupling between the control lever and the displacement setting device, which was provided in the known art for an emergency actuation of the displacement setting device, can be eliminated because the hydraulic natural setting torque of the displacement setting device makes a mechanical positive tracking of the displacement setting device by the actuated control level superfluous. It thereby becomes possible to provide a pressure cutoff function on a pump with a mechanical displacement volume control. The invention teaches that the positive coupling of the control lever with the displacement setting device can be eliminated and a pressure cutoff function is provided in which, by means of the pilot valve, a pressure signal is generated from the delivery line which counteracts the control pressure on the positioning piston and thus reverses the positioning torque on the displacement setting device. Consequently, when the pressure cutoff function responds, the pump is controlled in the direction of a reduction of the displacement volume. The intervention signal for the pressure cutoff function is sent over the shortest possible distance by the pressure signal that acts opposite to the control pressure. As a result, interference caused by friction is eliminated and response times are minimized by a short signal path. With a pressure cutoff function of this type which counteracts the control pressure of the positioning piston generated via the control valve and reverses the positioning torque of the displacement setting device, it becomes easily possible to provide a pressure cutoff function on a pump with a mechanical displacement volume control.

In one embodiment of the invention, the control valve has a first control pressure port in communication with a first control pressure chamber of the positioning piston, a second pressure port in communication with a second control pressure chamber of the positioning piston, a supply pressure port in communication with a supply pressure source, and a first tank port in communication with a reservoir, as well as a second tank port in communication with the reservoir. In a first switching position of the control valve, the first control pressure port is in communication with the supply pressure port and the second control pressure port is in communication with the second tank port, and the first tank port is closed. In a second switching position of the control valve, the second control pressure port is in communication with the supply pressure port and the first control pressure port is in communication with the first tank port and the second tank port is closed. The tank ports are each in communication with the reservoir by individual reservoir lines, in each of which a throttle device is located, whereby the pressure signal generated by the pilot valve is transmitted to the reservoir line upstream of the throttle device. With a control valve of this type which has separate tank drains, it is easily possible to transmit the pressure signal of the pressure cutoff function to the respective tank side of the positioning piston and thus to realize a pressure cutoff function for a bilaterally controllable pump. By means of the throttle device, the pressure signal generated from the pilot signal builds up in the reservoir line and counteracts the control pressure on the positioning piston. As a result, on account of the pressure signal, the positioning torque of the displacement setting device is reversed by the pressure signal and, therefore, the pressure cutoff function can be achieved in the acceleration phase and in the braking phase with little construction expense.

When the control valve is moved in the direction of the first switching position, the pump delivers into a first delivery line. When the control valve is moved in the direction of the second switching position, the pump delivers into a second delivery line. A first branch line is provided with the first pilot valve which connects the first delivery line with the second reservoir line of the control valve upstream of the throttle device, and a second branch line is provided with the second pilot valve which connects the second delivery line with the first reservoir line of the control valve upstream of the throttle device. Thus, it is easily possible to connect the respective reservoir line and thus the tank drain of the control valve via the corresponding branch line with the delivery line, so that a pressure cutoff function can be achieved in both delivery directions of the pump, in the acceleration phase and the braking phase.

In one embodiment of the invention, the pilot valves are pressure relief valves. With pressure relief valves, simply constructed pilot valves can be made available for the pressure cutoff function, as a result of which the pressure cutoff function entails a small amount of effort and expense in design and manufacture.

The control valve advantageously has a neutral position in which the control pressure ports, the tank ports, and the supply pressure ports are in communication with one another.

In one advantageous development of the invention, a logic device is provided, by means of which the pressure cutoff function can be turned on in the acceleration phase and turned off in the deceleration phase. With a logic device of this type, it becomes easily possible for the pressure cutoff function to be active only in the acceleration phase. As a result, different maximum pressures can be easily specified in the acceleration phase and the deceleration phase, and in the deceleration phase an improvement of the actuation time can be achieved with a pump that pivots back to reduce the displacement volume.

The logic device advantageously actuates the branch lines. As a result, only a simple switching effort is required to prevent a response of the pressure cutoff function in the deceleration phase and to ensure that the pressure cutoff function is active only in the acceleration phase.

In one embodiment, the logic device is a switching valve which in a neutral position closes the branch lines, in a first switching position opens the first branch line and closes the second branch line, and in a second switching position opens the second branch line and closes the first branch line. With a switching valve of this type, it is easily possible, by moving the switching valve into the appropriate switching position for the pressure cutoff function in the acceleration phase, to open the corresponding branch line connected to the delivery line and to close the other branch line, so that a response of the pressure cutoff function by the closed branch line, which is in communication with the delivery line that is carrying the braking pressure, can easily be prevented during the deceleration phase.

For example, the switching valve can be actuated electrically or hydraulically. It is particularly advantageous if the switching valve is in functional communication with the positioning piston or the displacement setting device so that when the control valve is actuated toward the first switching position, the switching valve is moved into the first switching position, and when the control valve is actuated toward the second switching position, the switching valve is actuated into the second switching position. With a switching valve which is in a mechanically functional connection with the displacement setting device or the positioning piston and is thus actuated mechanically, it is easily possible for the pressure cutoff function to be active only in the acceleration phase.

There are particular advantages to the use of a hydrostatic traction drive on a mobile work machine with a hydrostatic pump of the invention. With a pump with a variable displacement volume that can be controlled mechanically as taught by the invention and is provided with a pressure cutoff function, it becomes easily possible, for both directions of travel, to achieve a simply constructed pressure cutoff function with a stable control characteristic in the acceleration phase during the acceleration of the mobile work machine.

BRIEF DESCRIPTION OF THE DRAWINGS

Additional advantages and details of the invention are explained below on the basis of the exemplary embodiment illustrated in the accompanying schematic figures.

DESCRIPTION OF THE PREFERRED EMBODIMENTS

Figure 2:
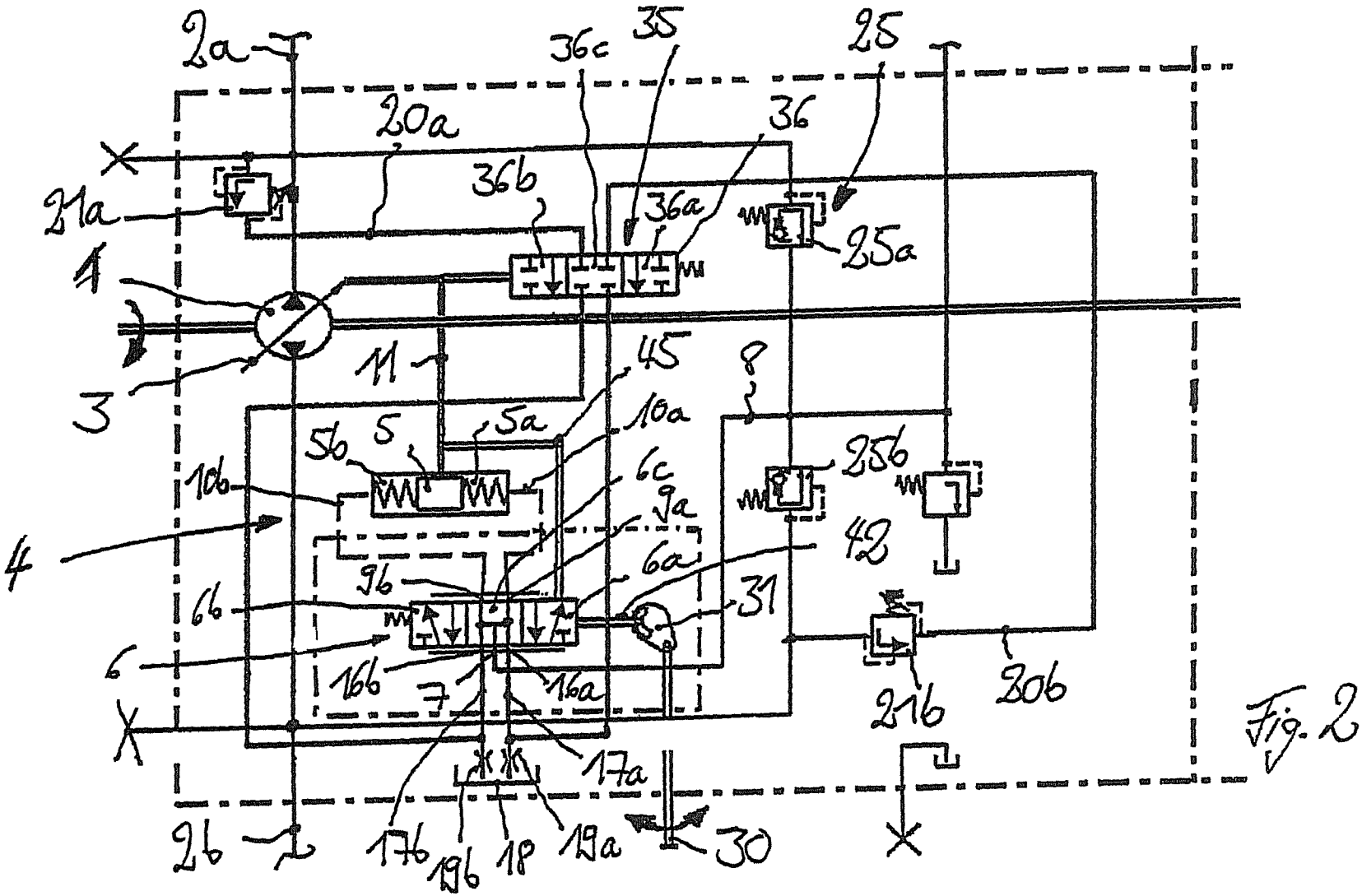
FIG. 2 is a circuit diagram of a pump system incorporating features of the invention.

FIG. 2 shows the circuit diagram of a pump 1 of the invention which is operated in a closed circuit, for example of a traction drive of a mobile work machine.

The pump 1 is driven by a drive motor which is not illustrated in any further detail, such as an internal combustion engine or an electric motor, for example, and is in communication via a first delivery line 2*a* and a second delivery line 2*b* which form the closed circuit with a consumer which is not illustrated in any further detail.

The pump 1 is a variable displacement pump and has a displacement setting device 3, such as a swashplate, for example, which is realized in the form of a cradle, which is functionally connected with a mechanical displacement volume control in the form of a mechanical control element 4.

The control element 4 has a spring-centered positioning piston 5 which is in functional communication with the displacement setting device 3 and is provided with a first control pressure chamber 5*a* and a second control pressure chamber 5*b*. Instead of a positioning piston with two control pressure chambers that work in opposition to each other, two positioning pistons, each with its own control pressure chamber, can also be provided.

For the control of the actuation of the positioning piston 5, a position-controlled control valve 6 realized in the form of a pilot valve is provided. The control valve 6 has a supply pressure port 7 which is in communication with a supply pressure line 8 of a supply pressure source which is not illustrated in any further detail and can be realized in the form of a control pressure pump. The control valve 6 also has a first control pressure port 9*a* which is in communication by means of a first control pressure line 10*a* with the first control pressure chamber 5*a* of the positioning piston 5. A second control pressure port 9*b* of the control valve 6 is in communication by means of a second control pressure line 10*b* with the second control pressure chamber 5*b* of the positioning piston 5.

Figure 1A:
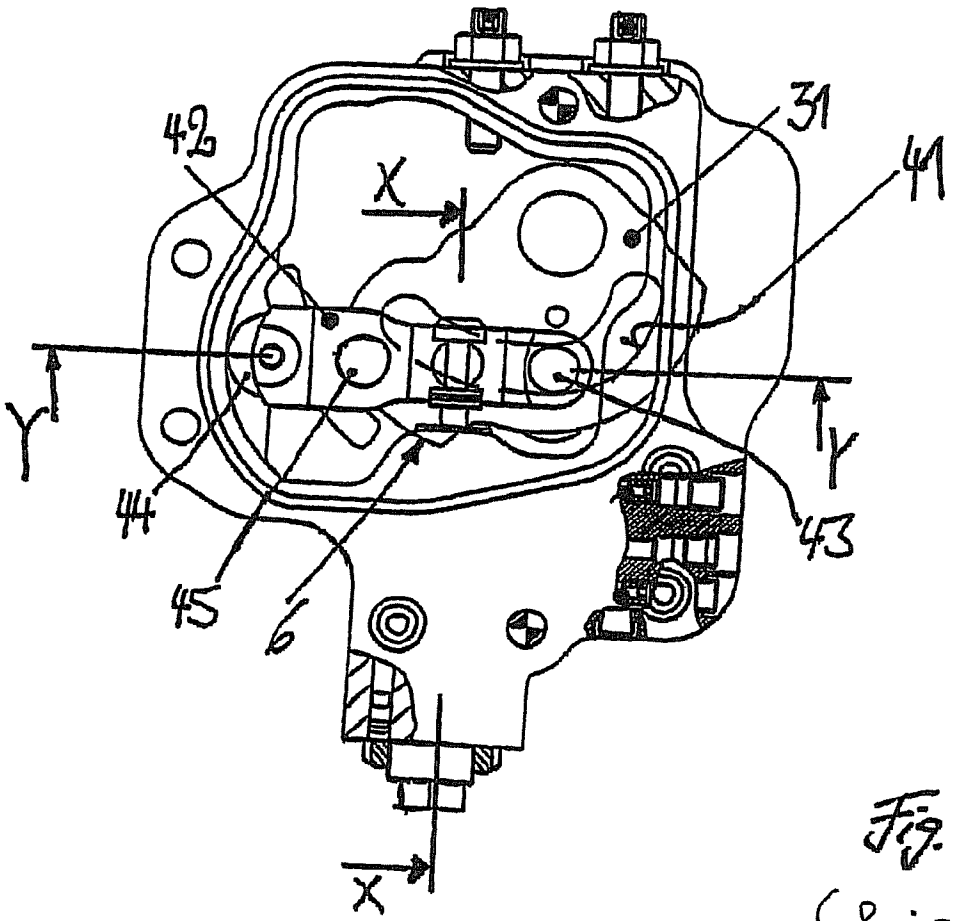
Fig. 1a (Prior Art)
FIG. 1*a* shows a mechanical displacement volume control device of the known art.
Figure 1C:
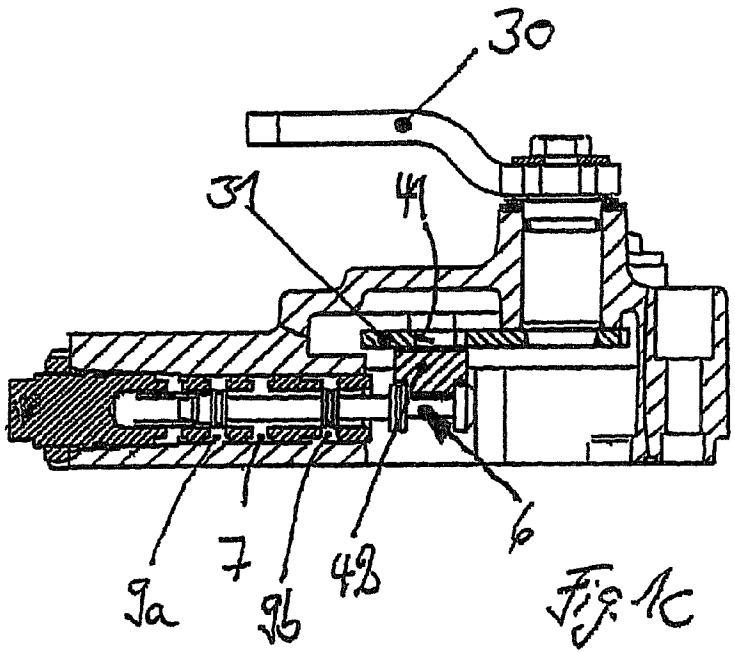
Fig. 1C (Prior Art)
FIG. 1*c* is a sectional drawing along line X-X in FIG. 1*a*.
Figure 1B:
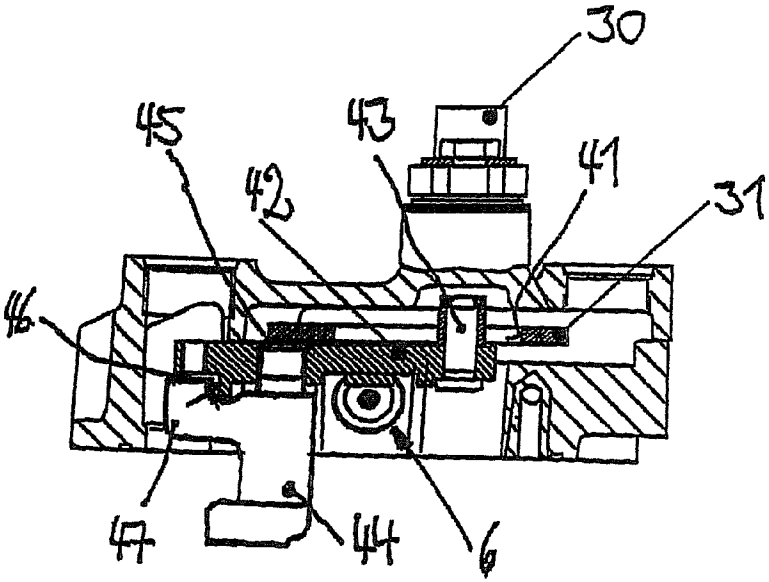
Fig. 1b (Prior Art)
FIG. 1*b* is a sectional drawing along line Y-Y in FIG. 1*a;*

The control valve 6 is thereby actuated mechanically, whereby a control lever 30 is functionally connected with the spool element of the control valve 6 by means of a cam plate 31, for example. As illustrated in FIGS. 1*a* to 1*c*, the cam plate 41 can thereby be placed in a functional connection with the spool element of the control valve 6 by means of the actuator lever 42.

The positioning piston 5 and thus the displacement setting device 3 are in a functional connection by means of a mechanical linkage 11 with the spool element of the control valve 6. The actuation of the spool element of the control valve 6 by means of the cam plate 31 and the feedback on the position of the displacement setting device 3 can be done in the manner of the known art as illustrated in FIGS. 1*a* to 1*c* by means of the actuator lever 42, whereby the linkage 11 is formed by the assembly 44 and the pin 45. It is also possible, however, to couple the spool element of the control valve 6 with the control lever 30 and to obtain the feedback on the position of the displacement setting device by means of an axially movable housing sleeve of the control valve which surrounds the spool element.

The mechanical construction of the mechanical displacement volume control device of the pump of the invention is essentially the same as the construction illustrated in FIGS. 1*a* to 1*c*. However, the positive coupling of the known art illustrated in FIGS. 1*a* to 1*c* between the control lever 30 and the displacement setting device is eliminated. For this purpose, for example, the assembly 44 in FIGS. 1*a* to 1*c* can be provided with no pin 47 and/or the actuator lever 42 in FIGS. 1*a* to 1*c* can be provided with no notch 46. It is also possible to shorten the actuator lever 42 after the pin 45.

The control valve 6 (as shown in FIG. 2) is provided with a first tank port 16*a* and a second tank port 16*b*. In a first switching position 6*a* of the control valve 6, the first control pressure chamber 5*a* of the positioning piston 5 is in communication via the control pressure line 10*a* and the control pressure port 9*a* with the supply pressure port 7, and the second control pressure chamber 5*b* of the positioning piston 5 is in communication via the control pressure line 10*b* with the second tank port 16*b* and, thus, with a reservoir 18. In a second switching position 6*b* of the control valve 6, the second control pressure chamber 5*b* of the positioning piston 5 is in communication via the control pressure line 10*b* and the control pressure port 9*b* with the supply pressure port 7. In this switching position 6*b*, the first control pressure chamber 5*a* of the positioning piston 5 is in communication via the control pressure line 10*a* with the first tank port 16*a* and, thus, with the reservoir 18.

In the first switching position 6*a*, the first tank port 16*a* is closed. Accordingly, in the second switching position 6*b*, the second tank port 16*b* is closed. In the illustrated neutral position 6*c* of the control valve 6, the control pressure ports 9*a*, 9*b* and the supply pressure port 7 are in communication with the tank ports 16*a*, 16*b*.

From the first tank port 16*a* of the control valve 6, a first reservoir branch line 17*a* leads to the reservoir 18 in which a throttle device 19*a* is located. Upstream of the throttle device 19*a*, a second branch line 20*b* is connected to the first reservoir branch line 17*a*, which second branch line 20*b* is in communication with the interposition of a logic device 35 with the second delivery line 2*b*. A pilot valve 21*b* which is realized in the form of a pressure relief valve is thereby located in the branch line 20*b*.

Accordingly, in a second reservoir branch line 17*b* that leads from the second tank port 16*b* of the control valve 6 to the reservoir 18, there is a throttle device 19*b*. Connected upstream of the throttle device 19*b* is a first branch line 20*a*, which is in communication with the interposition of the logic device 35 with the first hydraulic fluid line 2*a*. Also located in the branch line 20*a* is a pilot valve 21*a* realized in the form of a pressure relief valve.

The throttle devices 19*a*, 19*b* can in this case be realized either in the form of orifices or throttles.

To protect the circuit, an overpressure protection device 25 is provided which includes a combination pressure relief (anti-cavitation valves 25*a*, 25*b*), whereby one pressure relief (anti-cavitation valve 25*a*) is in communication with the hydraulic fluid line 2*a* and the other pressure relief (anti-cavitation valve 25*b*) is in communication with the hydraulic fluid line 2*b*. The pressure relief (anti-cavitation valves 25*a*, 25*b*) are thereby connected to the supply pressure line 8 to feed a charge flow.

The logic device 35 is a switching valve 36 and has a neutral position 36*c* in which the branch lines 20*a*, 20*b* are closed. In a first switching position 36*a*, the first branch line 20*a* is opened and the second branch line 20*b* is closed. Accordingly, in a second switching position 36*b*, the second branch line 20*b* is opened and the first branch line 20*a* is closed.

The switching valve 36 is also mechanically actuated and is functionally connected with the positioning piston 5 or the displacement setting device 3, for example, via the linkage 11. When the control valve 6 is actuated in the direction of the first switching position 6*a*, the switching valve 36 hereby moves into the first switching position 36*a*, and when the control valve 6 is actuated in the direction of the second switching position 6*b*, the switching valve 36 is moved into the second switching position 36*b*.

When the pilot valve of the control valve 6 is moved by the control lever 30 toward the switching position 6*a*, in which the control pressure line 10*a* is in communication with the supply pressure line 8, a control pressure is generated in the control pressure chamber 5*a*, which moves the positioning piston 5 to the left as shown in FIG. 2 and actuates the displacement setting device 3 of the pump 1 in the direction of an increase in the delivery flow. The pump 1 thereby delivers into the hydraulic fluid line 2*a*. By means of the linkage 11, the switching valve 36 is also moved into the first switching position 36*a*, in which the first branch line 20*a* is opened and the second branch line 20*b* is closed.

The control pressure chamber 5*b* of the positioning piston 5 is in communication via the control pressure line 10*b* in the switching position 6*a* of the switching valve 6 with the second tank port 16*b* and, thus, with the second reservoir branch line 17*b*. In the acceleration phase of the traction drive, the delivery pressure delivered by the pump 1 into the delivery line 2*a* is available via the branch line 20*a* at the pilot valve 21*a*. If the delivery pressure of the pump 1 in the acceleration phase exceeds the maximum delivery pressure specified at the pilot valve 21*a*, the pilot valve 21*a*, which is realized in the form of a pressure relief valve, is actuated into the open position. Via the branch line 20*a*, which is opened by the logic device 35, and the throttle device 19*b* located in the reservoir branch line 17*b*, a pressure signal is thereby built up at the second tank port 16*b* of the control valve 6 which is available via the control pressure line 10*b* in the control pressure chamber 5*b* of the positioning piston 5 and moves the positioning piston 5 opposite to the control pressure which is available in the control pressure chamber 5*a*. Consequently, the positioning torque of the displacement setting device 3 is reversed, as a result of which the displacement setting device 3 is actuated to cut off the pressure in the direction of a reduction of the displacement.

If the traction drive is in the deceleration phase, a pressure change takes place in the delivery lines 2*a*, 2*b*. In the delivery line 2*b*, a braking pressure is thereby available which drives the pump 1 which is now operating as a motor. The braking pressure in the delivery line 2*b* continues to be available via the branch line 20*b* at the pilot valve 21*b*. However, the branch line 20*b* is thereby closed by the switching valve 36 which is in the first switching position 36*a*. By means of the logic device 35 which is realized in the form of a switching valve 36, it is thereby possible to prevent, in a simple manner, the pressure signal generated by the pilot valve 21*b* which is in communication with the throttle valve 19*a* from reaching the reservoir drain of the control valve 6, and, thus, the response of the pressure cutoff function in the braking phase.

Accordingly, when the switching valve 6 is actuated by means of the control lever 30 toward the second switching position 6*b*, where the pump 1 delivers into the delivery line 2*b*, a pressure cutoff function in the acceleration phase of the traction drive is achieved by means of the pilot valve 21*b*, the throttle 19*a*, and the switching valve 36 which is actuated into the second switching position 6*b*. The logic device 35 thereby also prevents a response of the pressure cutoff function in the braking phase.

The pressure cutoff is thereby achieved by a build-up of a pressure signal taken from the delivery line 2*a* or 2*b* in the corresponding reservoir discharge of the control valve 6, whereby the pressure signal directly counteracts the control pressure on the positioning piston 5 and, thus, reverses the positioning torque of the displacement setting device 3 which is realized in the form of a swashplate. Interference caused by friction can thereby be reduced. In addition, there is a faster signal routing for the pressure cutoff function with shorter delay times. The pivoting of the displacement setting device 3 of the pump 1 to limit the pressure in the acceleration phase thereby occurs independently of the natural setting torque on the displacement setting device 3 which results from the delivery pressure. As a result of the realization of the pilot valves 21*a*, 21*b* in the form of pressure relief valves and the use of throttles as throttle devices 19*a*, 19*b*, an effective pressure cutoff function is realized in the acceleration phase with simple components and at a low cost, with a stable control characteristic for a pump 1 with a mechanically controlled displacement volume.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic pump with a variable displacement volume that is operable in a closed circuit, comprising:

a mechanical displacement volume control with a mechanical control element which, to generate a control pressure that acts on a positioning piston which is functionally connected with a displacement setting device, has a position-controlled control valve functionally connected with a control lever and with the displacement setting device of the pump, wherein the control lever is mechanically decoupled from the displacement setting device, wherein a pressure cutoff function is provided with which, by means of respective pilot valves, a pressure signal is generated from a delivery line of the pump, which signal is transmitted via the control valve to the positioning piston and counteracts the control pressure.

2. The hydrostatic pump as recited in claim 1, wherein the control valve has a first control pressure port in communication with a first control pressure chamber of the positioning piston, a second control pressure port in communication with a second control pressure chamber of the positioning piston, a supply pressure port in communication with a supply pressure source, a first tank port in communication with a reservoir, and a second tank port in communication with the reservoir, wherein in a first switching position of the control valve, the first control pressure port is in communication with the supply pressure port and the second control pressure port with the second tank port and the first tank port is closed, and in a second switching position of the control valve, the second control pressure port is in communication with the supply pressure port and the first control pressure port with the first tank port and the second tank port is closed, wherein the tank ports are each in communication with a respective reservoir line with the reservoir, in each of which there is a throttle device, and wherein the pressure signal generated by the pilot valve is transmitted to the reservoir line upstream of the throttle device.

3. The hydrostatic pump as recited in claim 2, wherein the pump, when the control valve is moved toward the first switching position, delivers into a first delivery line, and when the control valve is moved toward the second switching position, delivers into a second delivery line, wherein a first branch line provided with the first pilot valve connects the first delivery line with the second reservoir line of the control valve upstream of the throttle device and there is a second branch line which is in communication with the second pilot valve, which branch line connects the second delivery line with the first reservoir line of the control valve upstream of the throttle device.

4. The hydrostatic pump as recited in claim 1, wherein the pilot valves are pressure relief valves.

5. The hydrostatic pump as recited in claim 2, wherein the control valve has a neutral position in which the control pressure ports, the tank ports, and the supply pressure ports are in communication with one another.

6. The hydrostatic pump as recited in claim 3, including a logic device, by means of which a pressure cutoff function, is turned on in the acceleration phase and turned off in the deceleration phase.

7. The hydrostatic pump as recited in claim 6, wherein the logic device actuates the branch lines.

8. The hydrostatic pump as recited in claim 6, wherein the logic device is a switching valve which in a neutral position closes the branch lines, in a first switching position opens the first branch line and closes the second branch line, and in a second switching position opens the second branch line and closes the first branch line.

9. The hydrostatic pump as recited in claim 8, wherein the switching valve is in functional communication with the positioning piston or the displacement setting device so that when the control valve is moved toward the first switching position, the switching valve is moved into the first switching position and when the control valve is moved toward the second switching position, the switching valve is moved into the second switching position.

10. A hydrostatic traction drive for a mobile work machine having a hydrostatic pump as recited in claim 1.

* * * * *